US008555712B2

(12) United States Patent
Narvaez et al.

(10) Patent No.: US 8,555,712 B2
(45) Date of Patent: Oct. 15, 2013

(54) OUTSIDE CASING CONVEYED LOW FLOW IMPEDANCE SENSOR GAUGE SYSTEM AND METHOD

(75) Inventors: Gonzalo Zambrano Narvaez, Edmonton (CA); Richard John Chalaturnyk, St-Albert (CA); Peter Lang, Edmonton (CA)

(73) Assignee: Opsens Inc., Quebec QC (CA)

( * ) Notice: Subject to any disclaimer, the term of this patent is extended or adjusted under 35 U.S.C. 154(b) by 482 days.

(21) Appl. No.: 13/012,437

(22) Filed: Jan. 24, 2011

(65) Prior Publication Data

US 2011/0186294 A1 Aug. 4, 2011

Related U.S. Application Data

(60) Provisional application No. 61/297,518, filed on Jan. 22, 2010.

(51) Int. Cl.
*E21B 47/00* (2012.01)

(52) U.S. Cl.
USPC ..... 73/152.18

(58) Field of Classification Search
USPC ..... 73/152.18, 152.29, 152.36, 152.54, 73/152.57; 166/66, 258
See application file for complete search history.

(56) References Cited

U.S. PATENT DOCUMENTS 3,777,819 A * 12/1973 Delano ..... 166/285
4,441,362 A * 4/1984 Carlson ..... 73/152.31
4,974,446 A * 12/1990 Vigneaux ..... 73/152.42
4,986,350 A * 1/1991 Czernichow ..... 166/65.1
5,353,873 A * 10/1994 Cooke, Jr. ..... 166/64

(Continued)

FOREIGN PATENT DOCUMENTS

| | | |
|---|---|---|
| CA | 2514676 Y | 3/1999 |
| GB | 2397594 | 7/2004 |
| WO | WO 2010/019958 | 2/2010 |

OTHER PUBLICATIONS

PCT/International Search Report (ISR)—and the Written Opinion of the International Searching Authority, PCT/CA2011/000095 (Form PCT/ISA/210)—May 13, 2011—11 pages.

*Primary Examiner* — John Fitzgerald
(74) *Attorney, Agent, or Firm* — Benoît & Côté Inc.

(57) ABSTRACT

The present document describes a sensing apparatus for lowering into a well and cementing therein at a certain depth. The sensing apparatus comprises an elongated casing and a sensor device protruding from an outside surface of the elongated casing for generating measurement data and sending the data to the surface of the well using a cable extending from the sensor device along the outside surface of the casing. A flow of cement is provided between the outside surface of the casing and the well for cementing the casing in place and isolating different layers of the well. Presence of the sensor device and the cable creates an obstruction within the flow path of the cement which may result in the formation of micro-annulus around the sensor device and the cable. In order to address this problem, a plurality of fins is provided around the casing, the fins being shaped to cause a straight flow of cement received at the fins to rotate around the longitudinal axis of the casing when exiting the fins for increasing cement flow between the elongated casing and its surrounding environment to mitigate micro-annulus formation. Another means to address this problem is to provide cable attachments which distance the cable from the casing and thereby let cement flow between the cable and the casing also mitigating micro-annulus formation.

23 Claims, 7 Drawing Sheets

(56) References Cited

U.S. PATENT DOCUMENTS

| | | | | |
|---|---|---|---|---|
| 6,230,557 | B1 * | 5/2001 | Ciglenec et al. | 73/152.01 |
| 6,311,774 | B1 | 11/2001 | Brockman | |
| 6,840,336 | B2 * | 1/2005 | Schaaf et al. | 175/27 |
| 7,152,676 | B2 * | 12/2006 | Vella et al. | 166/250.14 |
| 7,250,768 | B2 * | 7/2007 | Ritter et al. | 324/369 |
| 7,278,484 | B2 * | 10/2007 | Vella et al. | 166/298 |
| 7,380,597 | B2 * | 6/2008 | Edwards et al. | 166/250.01 |
| 7,576,543 | B2 * | 8/2009 | Ritter et al. | 324/369 |
| 8,393,417 | B2 * | 3/2013 | Earles et al. | 175/324 |
| 2002/0179336 | A1 * | 12/2002 | Schaaf et al. | 175/61 |
| 2005/0109508 | A1 * | 5/2005 | Vella et al. | 166/297 |
| 2007/0034375 | A1 * | 2/2007 | Vella et al. | 166/298 |
| 2010/0039879 | A1 * | 2/2010 | Buytaert | 366/6 |
| 2011/0198090 | A1 * | 8/2011 | Buytaert et al. | 166/309 |

* cited by examiner

OUTSIDE CASING CONVEYED LOW FLOW IMPEDANCE SENSOR GAUGE SYSTEM AND METHOD

CROSS-REFERENCE TO RELATED APPLICATIONS

This application claims priority from U.S. Provisional Application No. 61/297,518 filed on Jan. 22, 2010, which is incorporated herein by reference in its entirety.

TECHNICAL FIELD

The present disclosure relates to downhole reservoir surveillance systems, and more particularly to sensing apparatus for being cemented at given elevations or zones inside a well so as to mitigate hydraulic communication between the zones.

BACKGROUND

Downhole reservoir surveillance systems often consist of sensors (pressure & temperature) that are lowered into a well and cemented in place at specific elevations to make contact with the geological formation of interest, for the sake of measuring in-situ pressure and temperature. Often, these sensors are packaged in steel housings that are usually welded to the outside of the casing, and designed for mechanical protection of the delicate sensor. This way, the sensor is carried downhole with the casing that it is attached thereto. A signal cable runs from the sensor (downhole) to the surface, to convey the sensor measurements.

In many installations, more than one sensor is lowered into the same well, with each designed to measure physical phenomena within a zone of interest. In these types of installations, prevention of hydraulic communication between two or more zones of interest is preferable for measurement precision. The sensors are thus typically cemented in place within the wellbore, and it is the cement that acts as a barrier for migration of in-situ fluids from zone to zone. In this case, the potential for leakage in between zones however still remains due to the micro annulus formation around the sensor and the sensor signal cables from lower zones passing through upper zones of interest (since they run all the way up to surface). Therefore, if not cemented properly, the surrounding environment of the sensor(s) and the cables connected thereto may create a micro-annulus in which gas or liquid is able to travel, thus compromising the zonal isolation.

There is thus a need for a downhole surveillance system and method with improved downhole sensing apparatus which addresses at least some of the above noted limitations association with the prior art.

SUMMARY

The system described herein provides a means to prevent the creation of a micro-annulus along the sensor cable. The goal is to have cement contacting all surfaces of the downhole components (casing, sensor housing, sensor cables, and the formation itself).

The cement will not do this naturally, as every obstruction or irregular shaped component that is located within the flow path of the cement will result in a non-homogenous flow regime. This, in turn, will result in volumes around the sensor housing and cables where there is cement of very poor quality (highly permeable) or no cement at all. These regions are referred to as "inadequate cement slurry volume fractions" (ISVF). The low flow impedance sensor housing system is constituted by a zero-vortex sensor housing, two sets flow deflector fins, and cable standoffs. The various components of the system address this problem.

In accordance with an embodiment, there is provided a sensing apparatus comprising an elongated casing for lowering from a surface into a well and cementing therein, the elongated casing comprising an outside surface, a lower end and an upper end opposite the lower end; a sensor device protruding from the outside surface, for generating measurement data indicative of an environmental parameter; a cable extending from the sensor device, along the outside surface toward the upper end, for transmitting the measurement data to the surface; and a plurality of fins disposed on the outside surface, the fins being shaped to cause a straight flow of cement received at the fins to rotate around the longitudinal axis of the elongated casing when exiting the fins for increasing cement flow between the elongated casing and the surrounding environment to mitigate micro-annulus formation along the elongated casing.

The casing may comprise a fluid pipe. In an embodiment, the fluid pipe is cylindrical.

In an embodiment, the apparatus further comprises cable attachments positioned along the casing between the sensor device and the upper end of the casing, the cable attachments being at least partially in between the casing and the cable for distancing the cable from the outside surface of the elongated casing.

In an embodiment, the plurality of fins comprises a first set of fins substantially equally spaced annularly on the outside surface between the sensor device and the lower end.

In an embodiment, the plurality of fins comprises a second set of fins provided around the casing and between the sensor device and the upper end of the casing, the fins of the second set being curved to re-rotate the upward flow of cement when exiting the second set of fins for increasing cement flow between the cable and the elongated casing to mitigate micro-annulus formation along the cable.

In an embodiment, the cable is provided at an angle with respect to the longitudinal axis of the elongated casing such that the upward flow of cement exiting the second set of fins is substantially perpendicular to the cable.

The sensor device may be elongated and may comprise a first end adjacent the first set of fins and a second end adjacent the second set of fins. The second set of fins may be provided between the first cable attachments after the sensor device and the second cable attachment after the sensor device. The cable may extend from the second end of the sensor device and between two adjacent fins of the second set.

Yet in a further embodiment, the sensor device may include an elongated housing and at least one sensor. The at least one sensor may comprise a temperature sensor and a pressure sensor. The at least one sensor may comprise two temperature sensors and two pressure sensors, each temperature sensor forming a pair with a pressure sensor, each pair having an output. The sensor device may comprise a first multiplexer for multiplexing the outputs of the two pairs of sensors and for sending the two outputs on the same cable. In an embodiment, the sensor device may comprise a second multiplexer for multiplexing the output of the first multiplexer with another sensor device of a lower casing in the well. In an embodiment, at least one of the first multiplexer and the second multiplexer comprises a Y splice.

In another aspect, there is provided a sensing apparatus comprising an elongated casing for lowering from a surface into a well and cementing therein, the elongated casing comprising an outside surface, a lower end and an upper end opposite the lower end; a sensor device protruding from an outside surface, for generating measurement data indicative of an environmental parameter; a cable extending from the sensor device, along the outside surface toward the upper end, for transmitting the measurement data to the surface; and cable attachments positioned along the outside surface between the sensor device and the upper end, the cable attachments for attaching the cable thereto at a distance from the outside surface such that cement flows between the elongated casing and the cable to mitigate micro-annulus formation along the elongated casing. In an embodiment, wherein the cable spirals upwardly from the sensor device around the elongated casing.

In a further aspect, there is provided a method for installing a sensing apparatus inside a well, the method comprising: lowering an elongated casing into the wellbore, the elongated casing having a sensor device protruding from an outside surface of the casing, and a signal transmitting cable extending from the sensor device; providing a flow of cement between the casing and an inner wall of the well; rotating the flow of cement around a longitudinal axis of the casing before arriving to the sensor device for increasing cement flow around the sensor device and mitigating micro-annulus formation.

In an embodiment, rotating comprises redirecting the cement flow around the casing using a plurality of fins around the casing between the sensor device and an end of the elongated casing at which the flow of cement between the casing and the well arrives first.

In a further embodiment, the method comprises, prior to lowering the elongated casing, lowering another casing into the wellbore, the other casing having an opening which allows fluids pushed downward inside the another casing to flow upward between an exterior surface of the another casing and the inner walls of the well.

In a further embodiment, the method further comprises rotating the flow of cement across the cable to mitigate micro-annulus formation along the cable.

In a further embodiment, the method further comprises providing the flow of cement between the elongated casing and the cable.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

The present document describes a sensing apparatus for lowering into a well and cementing therein at a certain depth. The sensing apparatus comprises an elongated casing and a sensor device protruding from an outside surface of the elongated casing for generating measurement data and sending the data to the surface of the well using a cable extending from the sensor device along the outside surface of the casing. A flow of cement is provided between the outside surface of the casing and the well for cementing the casing in place and isolating different layers of the well. Presence of the sensor device and the cable creates an obstruction within the flow path of the cement which results in the formation of micro-annulus around the sensor device and the cable. In order to address this problem, an embodiment presents a plurality of fins provided around the casing, the fins being shaped to cause a straight flow of cement received at the fins to rotate around the longitudinal axis of the casing when exiting the fins for increasing cement flow between the elongated casing and its surrounding environment to mitigate micro-annulus formation. Another embodiment presented herein discloses cable attachments which distance the cable from the casing and thereby let cement flow between the cable and the casing also mitigating micro-annulus formation.

Figure 1:
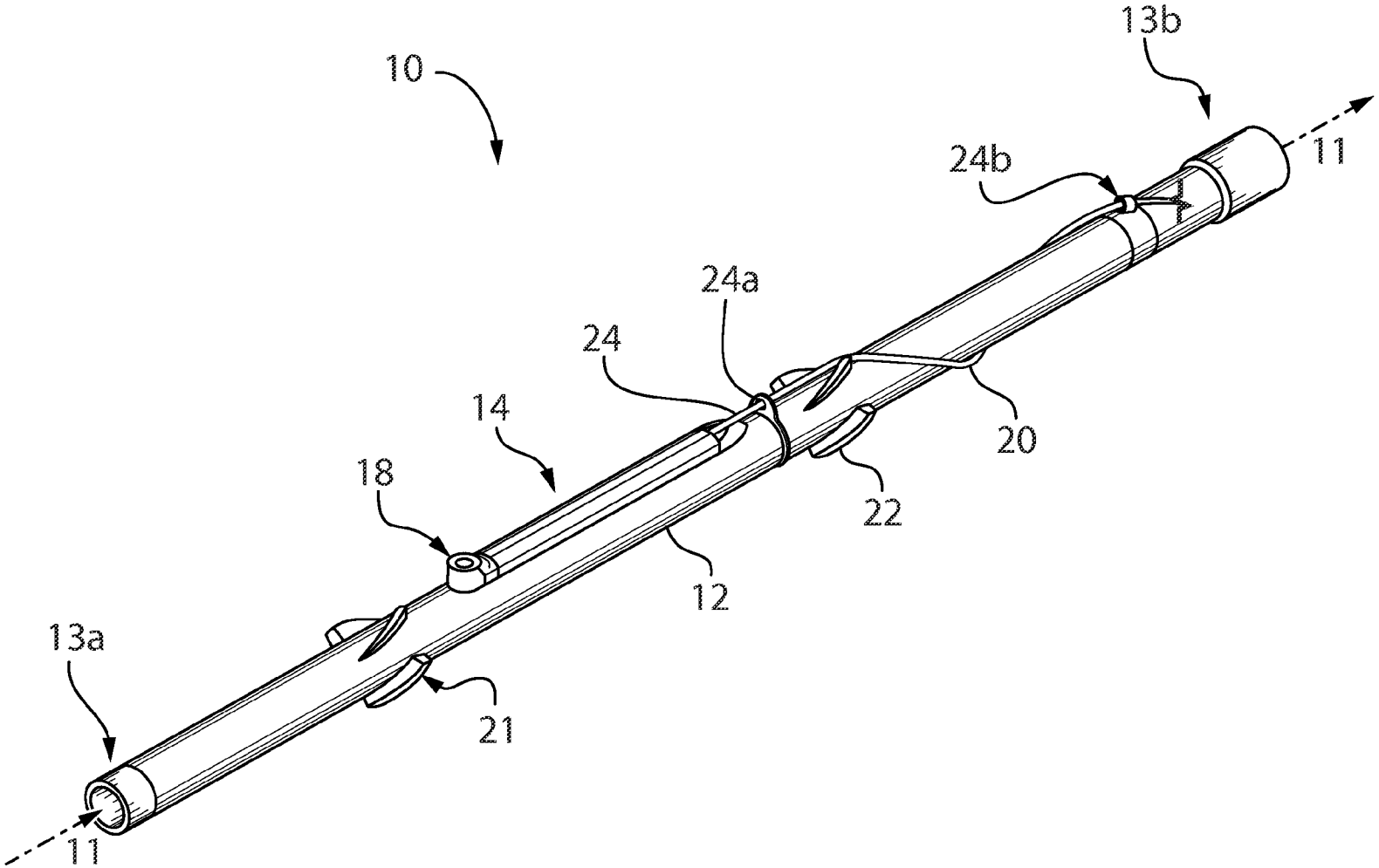
FIG. 1 is a schematic illustration of a downhole sensing apparatus in accordance with an embodiment.

FIG. 1 illustrates an example of a downhole sensing apparatus 10 in accordance with an embodiment. As shown in the example of FIG. 1, the sensing apparatus 10 comprises an elongated casing 12 from which a sensor device 14 partially protrudes. The signal is sent from the sensor device 14 to the surface of the well, into which the sensing apparatus 10 is to be installed, using a cable 20 which extends from the sensor device 14 along the casing 12.

In an embodiment, the casing defines a fluid pipe having a lower end 13*a* and an upper end 13*b* opposite the lower end. In an embodiment, the upper and lower ends include respective helical threads for connecting to other casings in the well.

One of the methods for cementing a selected casing in the well consists of providing a flow of cement between the exterior surface of the casing and the inner walls of the well (e.g., pumping the cement down and let it circulate back up along the outside of the casing). In one embodiment, the flow of cement is provided upward in the well, whereby, cement is pushed downward inside of the casing 12 to exit the lower end 13*a* and be received by a lower casing in the well (not shown). The lower casing includes one or more openings from which the cement exits and flows upward between the exterior surface of the casing and the inner walls of the well.

As discussed above, every obstruction or irregular shaped component along the flow path of the cement will result in gaps of no-cement and ISVF areas around the sensing apparatus 10. In order to reduce/eliminate the occurrence of ISVF around the sensor device 14 and/or cable 20, embodiments of the invention provide a mechanism which rotates the flow of cement around selected areas of the casing 12, where an obstruction or irregular shape exists.

In an embodiment, a first set of fins 21 is provided below the sensor device 14 (between the sensor device 14 and the lower end 13*a*). These devices balance the annular flow impedance that the sensor housing induces. The fins may be welded to the outside surface of the casing 12. The fins 21 are shaped (curved) to receive the straight flow of cement and rotate the latter as it exits the fins 21 in order to eliminate the presence of gaps and ISVF areas around the longitudinal sensor device 14.

The number of fins in each set is determined using Computational Fluid Dynamics (CFD) software. The CFD software takes into account casing diameter, cement rheological properties, downhole temperature, pressure, flow rates, etc. The number of fins is at least two. For a regular casing, the number of fins is generally four. In one embodiment, the fins are concentrically spaced around a diameter of the casing 12. The fins may take on respective shapes and angles with respect to the axis 11 of the casing 12. The shape and angle of each fin depends on: the rheology and the flow rates of the cement, the geometrical properties of the annular space formed by the sensing apparatus 10 as it is lowered in the wellbore (which includes for example the wellbore diameter), the dimensions of the casing 12, dimensions of the sensor device 14, and the location of the fins 21 relative to the location of the sensor device 14 on the casing 12.

According to an embodiment, the fins measure between 5 in. and 6 in. long. Also according to an embodiment, the angle made by the fins and the longitudinal axis of the casing is approximately 25 degrees.

Cable Attachments

In a preferred embodiment, the cable 20 is rotated around the casing 12 and attached to the latter using a set of cable attachment 24 provided between the cable 20 and the outside surface of the casing to distance the cable from the outside surface of the casing. The cable attachment 24 comprises a cable standoff 24*a* and a cable clamp 24*b*. The cable standoff 24*a* attaches to the cable 20 and is located between the sensor cable and the casing. This prevents the cable from contacting the casing and promotes cement flow between the cable and casing, thus preventing the formation of a micro-annulus. The cable clamp 24*b* clamps the sensor signal cable at a 45° angle to the axis of the casing, and also lifts it off the surface of the casing. In conjunction with this device, the cable is wrapped around the casing 360° and held in place with the cable clamp. These devices angle the cable relative to the flow direction of the cement. The flowing cement is forced to pass underneath the cable and minimizes the chance of a micro-annulus formation between the cable and the casing.

In some cases, the rotating flow of cement caused by the first set of fins 21 tends to be re-straightened before reaching the cable and/or cable attachment 24. In order to eliminate the micro-annulus formation and ISVF areas along the cable 20, a second set of fins 22 is provided adjacent and above the sensor device 14, between the sensor device 14 and the upper end 13*b* of the casing 12 to re-rotate the flow of cement in order to eliminate the presence of gaps and ISVF areas along the cable. The fins 22 are shaped and positioned so as to "twist" around the casing 12, in a direction opposite a twisting direction of the cable 20 around the casing 12. Such opposite twisting directionality between the fins 22 and the cable 20 induce a "cross-flow" of cement over and under the cable 20 (i.e. including within the distance formed between the cable 20 and the casing 12).

The number, shape and dimension of the fins 22 around the casing is determined in accordance with the parameters discussed above in connection with the fins 21. The angle/direction of curvature of the fins 22 is preferably the same as that of the fins 21, whereby the direction of rotation induced by the fins 22 is the same as that induced by the fins 21. However, the present embodiments may also be implemented with the fins 22 curved in an angle opposite to the angle of curvature of the fins 21.

Sensor Device

Figure 2:
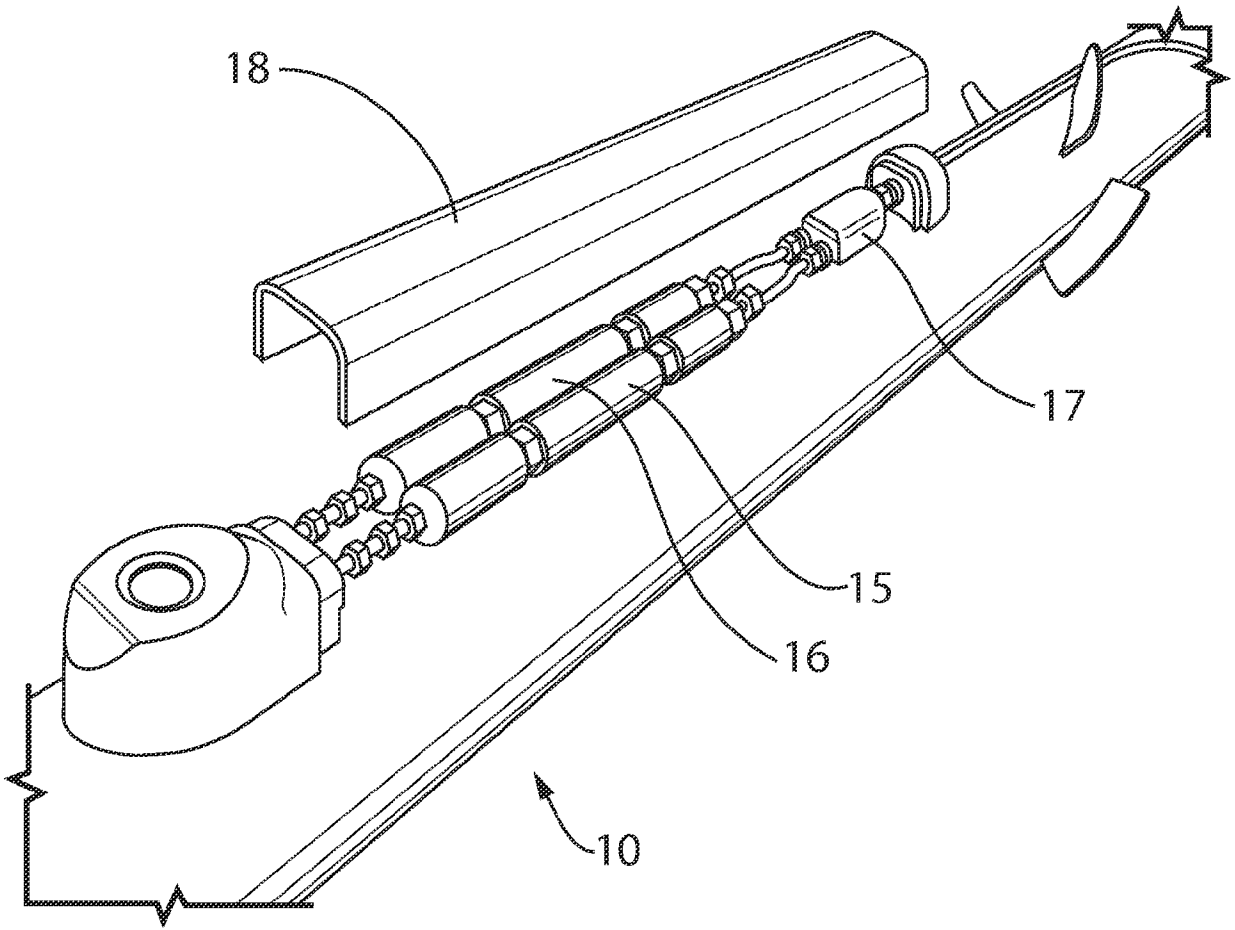
FIG. 2 illustrates an exploded view of an exemplary sensor device, in accordance with an embodiment.

FIG. 2 illustrates an exploded view of an exemplary sensor device 14, in accordance with an embodiment. The sensor device 14 comprises one or more sensors and a housing 18 enclosing the sensors. This protects the sensing elements (pressure/temperature gauge) during the installation, and allows the sensors to be in close contact to the formation fluid post-cementing. Generally sensor housing configuration with a computation flow analysis could create vortices that result in ISVF and potential micro-annulus. The housing design of OPS Zero-Vortex-Gauge (OPS-ZVG) resulted from mechanical and computational flow analysis reduces all the possible vortices, preserving the streamlines of the flow during cementing.

In the example of FIG. 2, the sensor device 14 comprises a temperature sensor and a pressure sensor gauges 15 and 16 (aka sensor pairs). This sensor arrangement provides redundancy in case of failure of one of the gauges. It is also to be noted that additional and different kinds of sensors may also be used without departing from the scope of this document. The outputs of the sensors are fed into a multiplexer 17 for sending the combined measurements on the same cable 20 to the surface of the well.

In some embodiments, each gauge 15 and 16 comprises only a pressure sensor or a temperature sensor.

In cases where more than one sensing apparatus are needed to provide different measurements at different depths of the well, different cables are required that run along different casings to reach the surface of the well. The presence of more than one cable complicates the problem further especially that the additional obstructions (cables and cable attachments) in the flow path of the cement will result in a non-homogenous flow regime. The present embodiments offer a solution to this problem by providing additional multiplexers in the sensor devices of the different sensing apparatuses.

Figure 3:
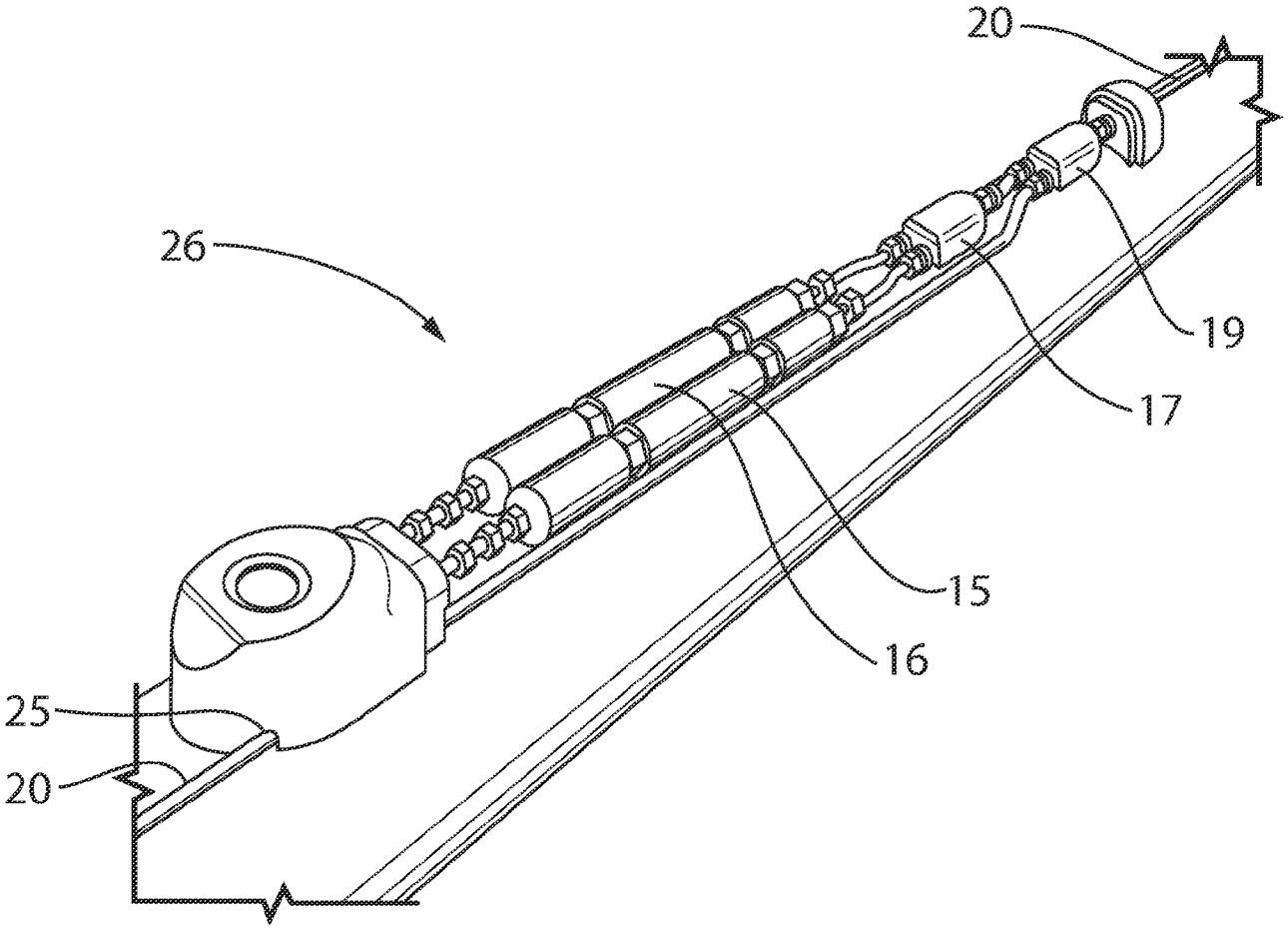
FIG. 3 illustrates the electrical components of a sensing apparatus provided between the surface of the well and at least one lower sensing apparatus in the well, in accordance with an embodiment.
Figure 4A:
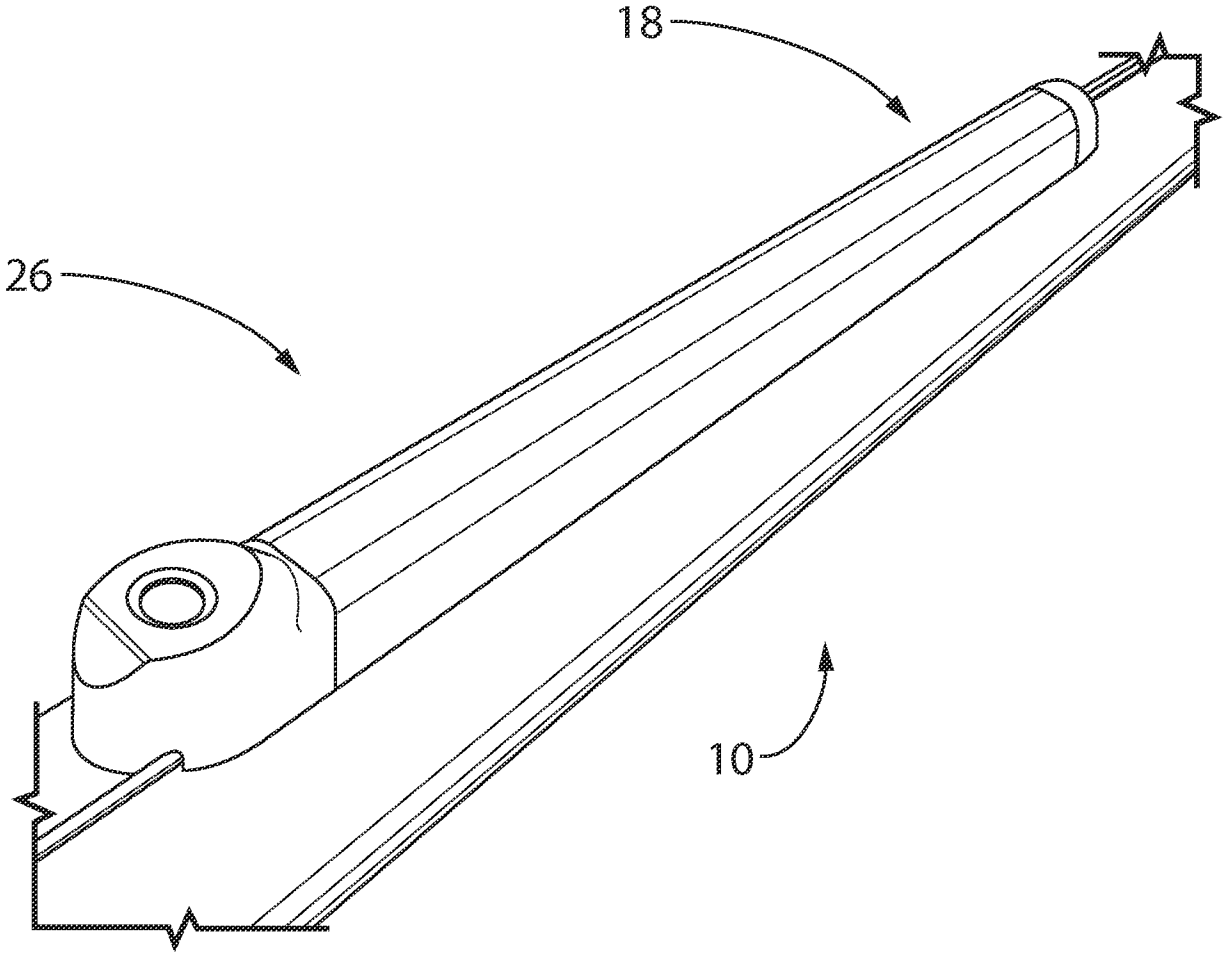
FIGS. 4*a* & 4*b* illustrate different views of the sensing apparatus of FIG. 3.
Figure 4B:
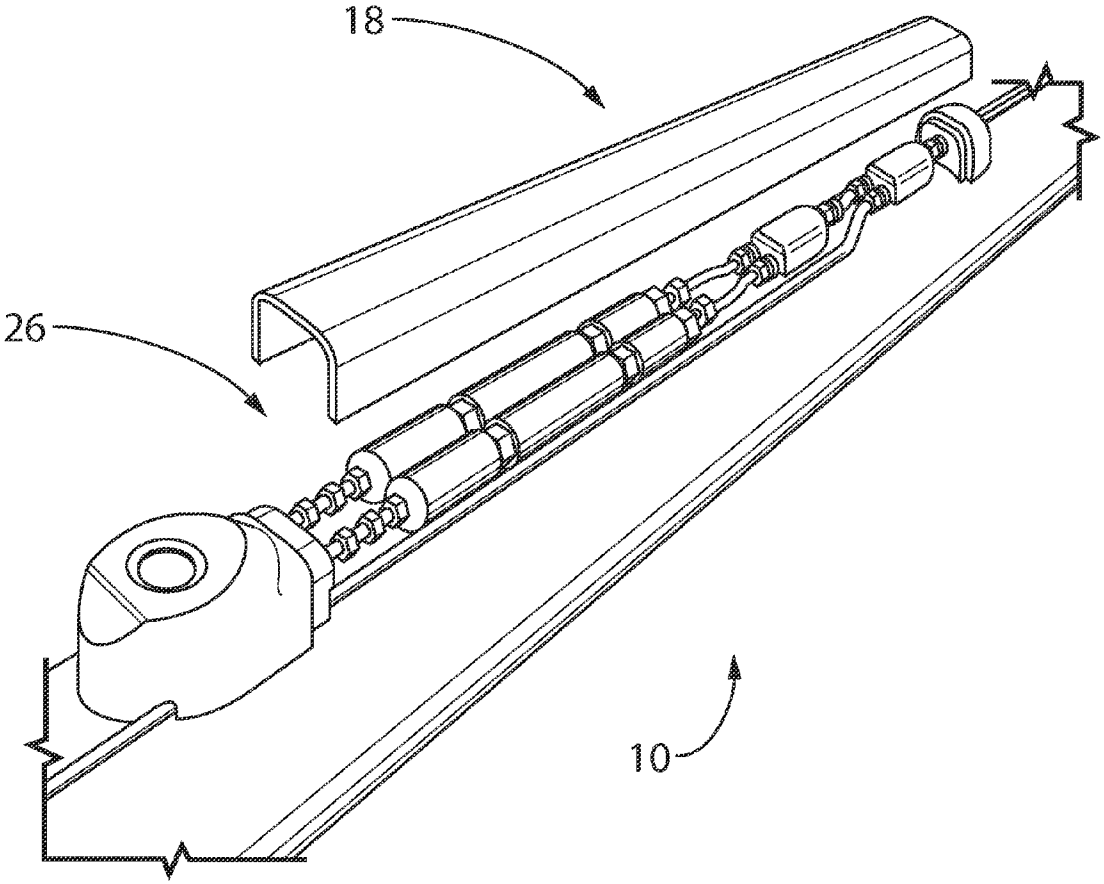

FIG. 3 illustrates the electrical components (without the casing) of a sensing apparatus 26 provided between the surface of the well and at least one lower sensing apparatus in the well, in accordance with an embodiment. FIGS. 4*a*&4*b* illustrate different views of the sensing apparatus 26 exemplified in FIG. 3.

As shown in FIG. 3, the sensor device comprises an opening 25 provided in the lower end thereof for receiving the cable 20 from a lower sensing apparatus. The signal sent on the cable 20 from the lower sensing apparatus and the output of the multiplexer 17 are fed to another multiplexer 19 in order to send all the signals on the same cable 20 passing through different sensing apparatuses of the same well.

Sensing Apparatus Installation

Figure 5:
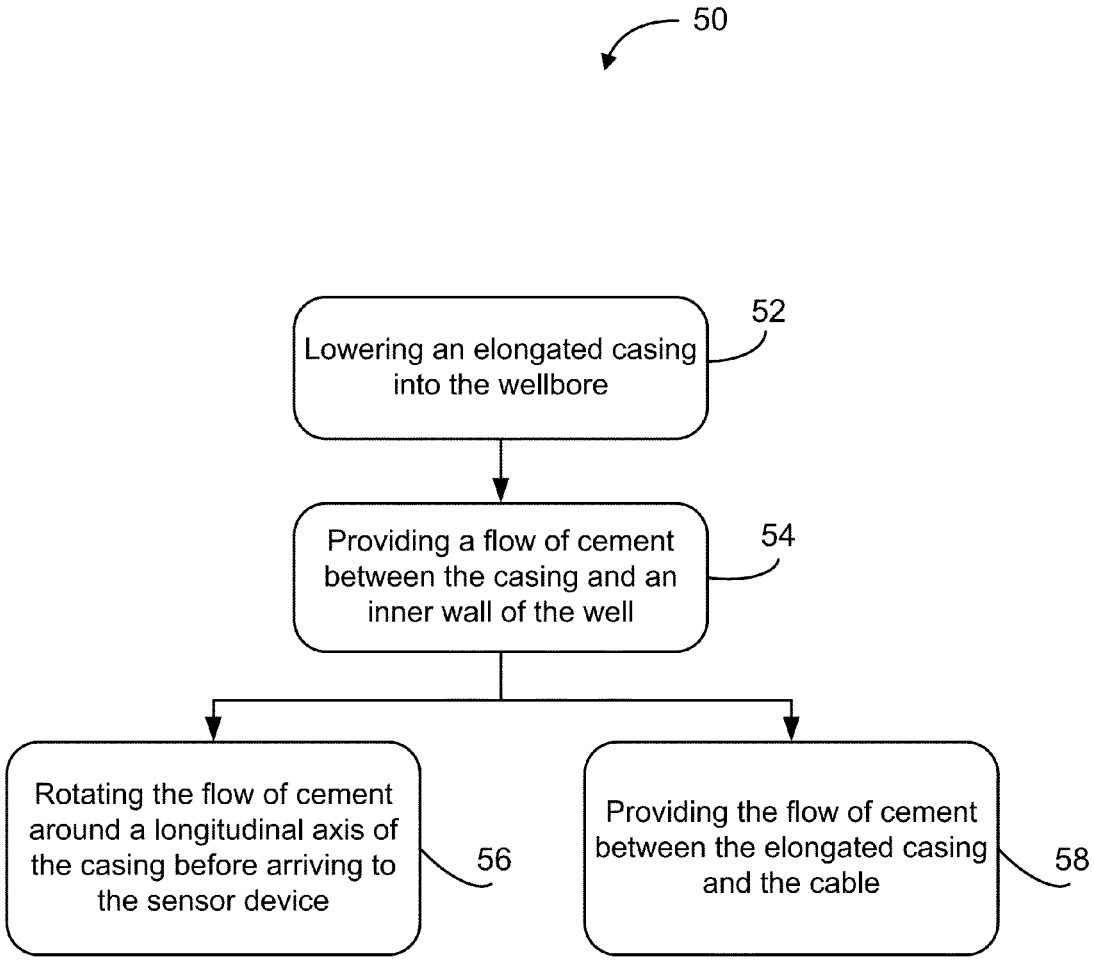
FIG. 5 is a flow chart of a method for installation of the downhole sensing apparatus of FIG. 1.

FIG. 5 illustrates a flow chart of one embodiment of a method 50 for installing a sensing apparatus inside a well so as to mitigate the formation of micro-annulus alongside the sensing device and/or the cable of the sensing apparatus. As per the above, reducing or eliminating the formation of micro-annulus reduces the risks of hydraulic communication between zones inside the well, which can lead to imprecise or faulty measurements especially when multiple sensing devices are used for each zone.

In step 52, the elongated casing is lowered into a wellbore. In one embodiment of the method 50, the sensing apparatus is such as that described hereinabove in relation to FIG. 1. For example, the casing has a sensor device coupled to a signal transmitting cable, and the signal transmitting cable extends from the sensor device, at a distance along an outside surface of the elongated casing.

In step 54, a flow of cement is provided between the elongated casing and an inner wall of the well in order to cement the casing in place. In an embodiment, the flow of cement is provided upward in the well, whereby the cement is first pushed downward inside of the elongated casing to be collected by another elongated casing below the elongated casing on which the sensing device is provided. The cement then exits from the lower casing and flows upward between the outside surface of the casing and the inner walls of the well. Therefore, one embodiment comprises lowering another casing into the wellbore prior to lowering the elongated casing. The other casing having an opening which allows fluids pushed downward inside the other casing to flow upward between an exterior surface of the other casing and the inner walls of the well.

In step 56, the cement is rotated around a longitudinal axis of the casing before arriving to the sensor device for increasing cement flow around the sensor device and mitigating micro-annulus formation. In an embodiment of step 56, rotating the cement flow comprises redirecting the cement flow around the casing using a plurality of fins around the casing between the sensor device and an end of the elongated casing at which the flow of cement between the casing and the well arrives first. In an embodiment, the fins are positioned concentrically on the outside surface of the casing, with a twisting direction.

Alternatively or in addition to the cement rotation step 56, the flow of cement is provided between the elongated casing and the cable in step 58.

The inside diameter of the elongated casing is wiped clean by pumping a wiper-plug down to the bottom (with water). The plug has water on top, and cement underneath and travels down the casing. As it moves down, more cement is circulated up the annulus of the well to the surface. When it reaches the bottom, it stays there and casing is sealed.

In an embodiment, the fins are twisted opposite a twisting direction of the cable around the casing. This scenario allows the fins to induce a cross-flow of cement within the distance created between the cable and the casing.

Although the casing is illustrated herein as being installed or for installation in an observation well, the casing can be adapted to be used in a production well also. The sensors, fins and cables are simply adapted to the size and environment of the production well.

Figure 6:
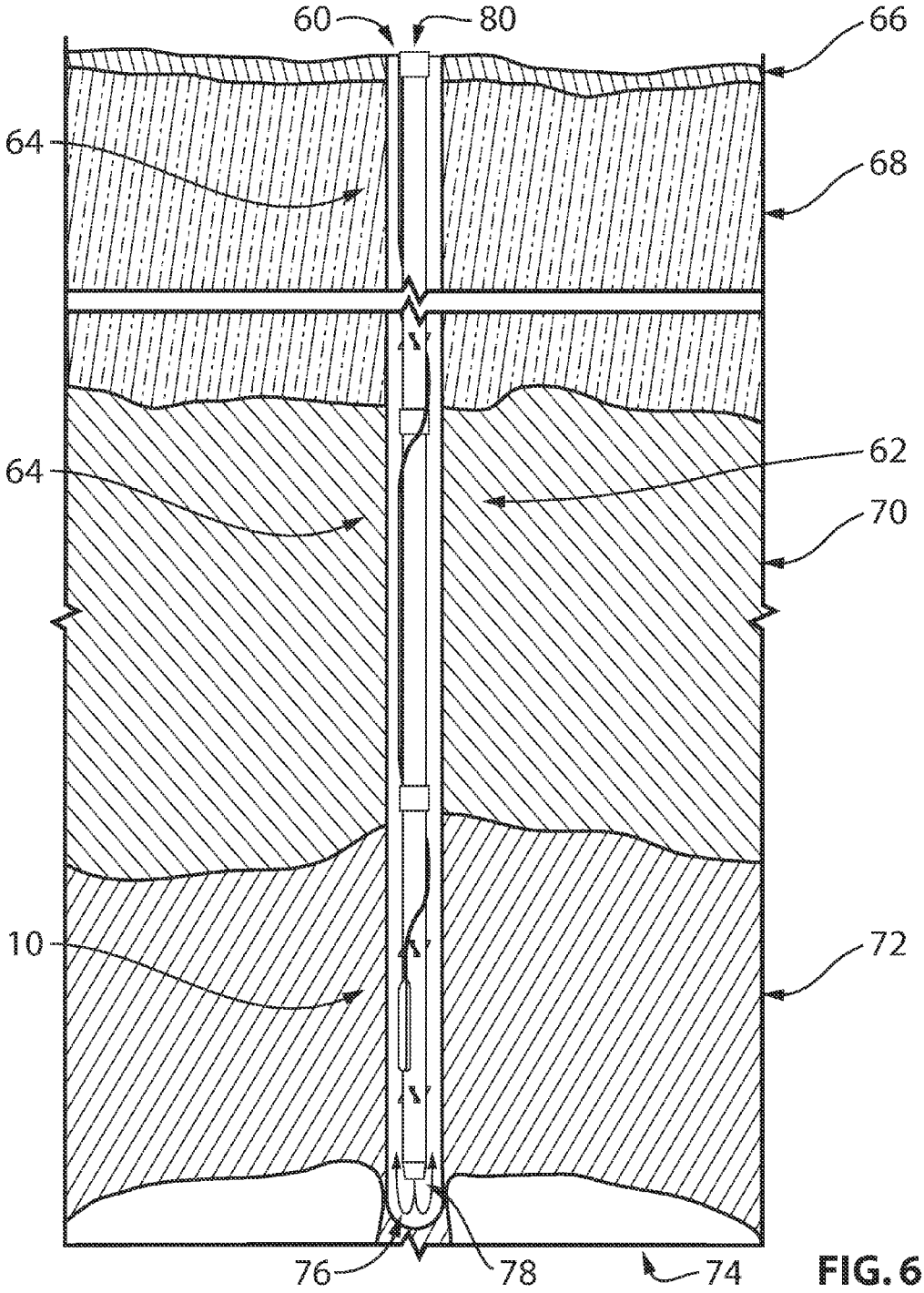
FIG. 6 is a partial cut-out view of the ground showing an observation well in which an assembly comprising an embodiment of a sensing apparatus is installed.

FIG. 6 is a partial cut-out view of the ground showing an observation well 60 in which an assembly 62 comprising an embodiment of a sensing apparatus 10 is installed. The assembly 62 also comprises other fluid pipe casings 64 which are not equipped with a sensor device. The ground is constituted of different types of matter 66, 68, 70, 72 and 74. The bottom of the observation well 76 provides a return path 78 for the cement (not shown) when it is poured/pushed down the series of casings from the upper end 80 of the first casing near ground level.

While preferred embodiments have been described above and illustrated in the accompanying drawings, it will be evident to those skilled in the art that modifications may be made therein without departing from the scope of this disclosure. Such modifications are considered as possible variants comprised in the scope of the disclosure.

The invention claimed is:

1. A sensing apparatus comprising:

an elongated casing for lowering from a surface into a well and cementing therein, the elongated casing comprising an outside surface, a lower end and an upper end opposite the lower end;

a sensor device protruding from the outside surface, for generating measurement data indicative of an environmental parameter;

a cable extending from the sensor device, along the outside surface toward the upper end, for transmitting the measurement data to the surface; and a plurality of fins disposed on the outside surface, the fins being shaped to cause a straight flow of cement received at the fins to rotate around the longitudinal axis of the elongated casing when exiting the fins for increasing cement flow between the elongated casing and a surrounding environment to mitigate micro-annulus formation along the elongated casing.

2. The sensing apparatus of claim 1, further comprising cable attachments positioned along the outside surface between the sensor device and the upper end, the cable attachments for attaching the cable thereto at a distance from the outside surface.

3. The sensing apparatus of claim 2, wherein the plurality of fins comprises a first set of fins substantially equally spaced annularly on the outside surface between the sensor device and the lower end.

4. The sensing apparatus of claim 3, wherein the plurality of fins comprises a second set of fins substantially equally spaced annularly on the outside surface between the sensor device and the upper end of the elongated casing, the fins of the second set of fins being curved to re-rotate the flow of cement when exiting the second set of fins for increasing cement flow between the cable and the elongated casing to mitigate micro-annulus formation along the cable.

5. The sensing apparatus of claim 4, wherein the cable is disposed on the outside surface at an angle with respect to a longitudinal axis of the elongated casing such that the upward flow of cement exiting the second set of fins is substantially perpendicular to the cable.

6. The sensing apparatus of claim 4, wherein the sensor device is elongated and comprises a first end adjacent the first set of fins and a second end adjacent the second set of fins.

7. The sensing apparatus of claim 4, wherein the second set of fins is provided between a first cable attachment from the sensor device and a second cable attachment from the sensor device.

8. The sensing apparatus of claim 4, wherein the number of fins on the first set of fins and on the second set of fins respectively is at least two.

9. The sensing apparatus of claim 4, wherein the fins of the second set re-rotate the flow of cement in the same direction of rotation induced by the first set of fins.

10. The sensing apparatus of claim 9, wherein at least one of a shape and a position of the fins are dependent on at least one of the following factors: rheology of the cement, flow rates of the cement, geometrical properties of an annular space formed by the sensing apparatus as it is lowered in the well, dimensions of the casing, dimensions of the sensor device, and the location of the fins relative to the location of a sensor housing on the elongated casing.

11. The sensing apparatus of claim 1, wherein the sensor device includes an elongated housing and at least one sensor.

12. The sensing apparatus of claim 11, wherein the at least one sensor comprises a temperature sensor and a pressure sensor.

13. The sensing apparatus of claim 12, wherein the at least one sensor comprises two temperature sensors and two pressure sensors, each temperature sensor forming a pair with a pressure sensor, each pair having an output.

14. The sensing apparatus of claim 13, further comprising a first multiplexer for multiplexing the outputs of the two pairs of sensors and for sending the two outputs on the same cable.

15. The sensing apparatus of claim 14, further comprising a second multiplexer for multiplexing the output of the first multiplexer with the output of another sensor device of a lower casing in the well.

16. The sensing apparatus of claim 15, wherein at least one of the first multiplexer and the second multiplexer comprises a Y splice.

17. A sensing apparatus comprising:

an elongated casing for lowering from a surface into a well and cementing therein, the elongated casing comprising an outside surface, a lower end and an upper end opposite the lower end;

a sensor device protruding from an outside surface, for generating measurement data indicative of an environmental parameter;

a cable extending from the sensor device, along the outside surface toward the upper end, for transmitting the measurement data to the surface; and cable attachments positioned along the outside surface between the sensor device and the upper end, the cable attachments for attaching the cable thereto at a distance from the outside surface such that cement flows between the elongated casing and the cable to mitigate micro-annulus formation along the elongated casing.

18. The sensing apparatus of claim 17, wherein the cable spirals upwardly from the sensor device around the elongated casing.

19. A method for installing a sensing apparatus inside a well, the method comprising:

lowering an elongated casing into the wellbore, the elongated casing having a sensor device protruding from an outside surface of the elongated casing, and a signal transmitting cable extending from the sensor device;

providing a flow of cement between the elongated casing and an inner wall of the well;

rotating the flow of cement around a longitudinal axis of the elongated casing before arriving to the sensor device for increasing cement flow around the sensor device and mitigating micro-annulus formation.

20. The method of claim 19, wherein rotating comprises:

redirecting the cement flow around the elongated casing using a plurality of fins around the casing between the sensor device and an end of the elongated casing at which the flow of cement between the elongated casing and the well arrives first.

21. The method of claim 19, further comprising, prior to lowering the elongated casing, lowering another casing into the wellbore, the another casing having an opening which allows fluids pushed downward inside the another casing to flow upward between an exterior surface of the another casing and the inner walls of the well.

22. The method of claim 19, further comprising rotating the flow of cement across the cable to mitigate micro-annulus formation along the cable.

23. The method of claim 19, further comprising providing the flow of cement between the elongated casing and the cable.

* * * * *